US007757971B2

(12) United States Patent
Hall et al.

(10) Patent No.: US 7,757,971 B2
(45) Date of Patent: Jul. 20, 2010

(54) DIAMOND NOZZLE

(75) Inventors: David R. Hall, Provo, UT (US); David Wahlquist, Spanish Fork, UT (US); Thomas Morris, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 409 days.

(21) Appl. No.: 11/747,341

(22) Filed: May 11, 2007

(65) Prior Publication Data

US 2008/0277506 A1 Nov. 13, 2008

(51) Int. Cl.
*B05B 1/00* (2006.01)

(52) U.S. Cl. ..... 239/591; 239/600; 239/595; 239/596; 239/597; 239/DIG. 19; 451/102

(58) Field of Classification Search ..... 239/591, 239/600, DIG. 19, 596, 597, 595; 175/393, 175/417; 451/102, 75
See application file for complete search history.

(56) References Cited

U.S. PATENT DOCUMENTS

| | | | | |
|---|---|---|---|---|
| 3,178,120 | A | 4/1965 | Kappel | |
| 4,528,782 | A | 7/1985 | Bean | |
| 5,365,702 | A * | 11/1994 | Shank, Jr. | 451/38 |
| 5,785,582 | A * | 7/1998 | Stefanik et al. | 451/102 |
| 6,425,805 | B1 * | 7/2002 | Massa et al. | 451/40 |
| 6,817,550 | B2 | 11/2004 | Taylor | |

* cited by examiner

*Primary Examiner*—Dinh Q Nguyen
(74) *Attorney, Agent, or Firm*—Holme Roberts & Owen LLP

(57) ABSTRACT

In one aspect of the invention, an abrasion resistant nozzle has at least two sintered diamond bodies having flat, mating, exterior surfaces and a thickness, the surfaces being held against each other under compression. An enclosure is formed between the mating surfaces, at least one surface having a groove forming a portion of the enclosure and the other surface forming a remaining portion of the enclosure. The enclosure connects an entry and an exit formed in at least one side of at least one of the bodies.

15 Claims, 10 Drawing Sheets

DIAMOND NOZZLE

BACKGROUND OF THE INVENTION

This invention relates to fluid nozzles used to clean, abrade, or cut materials or surfaces in industries such as road milling and resurfacing, downhole drilling, water jet cutting, coal furnaces, or other industries where fluids or micronized materials are emitted from nozzles. In such applications, the nozzles are often subjected to high temperatures, pressures, and/or abrasive materials or fluids and therefore experience a high amount of wear. For this reason, an abrasion resistant nozzle may be desired in order to prolong the life of the nozzle, which may lower cost for replacement and maintenance.

U.S. Pat. No. 4,528,782 to Bean, which is herein incorporated by reference for all that it contains, discloses an angular blasting nozzle having a replaceable section that substantially exclusively intercepts and turns abrasive flow from an inlet flow path to an obtuse outlet flow path. The nozzle is conveniently formed of a pair of mating, rectangular, prismatic sections which are well suited for fabrication from long-wearing materials such as tungsten carbide.

U.S. Pat. No. 6,817,550 to Taylor et al., which is herein incorporated by reference for all that it contains, discloses a nozzle with a longitudinal tubular body with an inner conduit or bore and a tapered distal dispensing end. A metal restraining shoulder at the proximal end can be used to fit the nozzle in a spray apparatus. The nozzle includes a substrate such as WC or CoCr or other suitable material and a diamond inner rod.

BRIEF SUMMARY OF THE INVENTION

In one aspect of the invention, an abrasion resistant nozzle has at least two sintered diamond bodies having flat, mating, exterior surfaces and a thickness, the surfaces being held against each other under compression. An enclosure is formed between the mating surfaces, at least one surface having a groove forming a portion of the enclosure and the other surface forming a remaining portion of the enclosure. The enclosure connects an entry and an exit formed in at least one side of at least one of the bodies.

The nozzle may comprise a band shrink fit around at least a portion of the two mating surfaces. The shrink fit may comprise an interference of 0.0001 to 0.002 inches. The nozzle may be a fluidic nozzle. The mating flat surfaces may be held under a compressive load of at least 2000 psi. The diamond bodies may comprise a thickness of at least 0.050 inches. The bodies may be compressively disposed within a chamber comprising a threaded plug. The nozzle may comprise an exit narrower than the entry. The enclosure may connect the entry and a plurality of exits. The entry and exit may be formed in the same side of one of the bodies. The entry and exit may be formed in different sides of one of the bodies. The entry and exit may be formed in different bodies. The diamond bodies may be closed and/or solid.

The groove may comprise a varied depth and/or width. The other surface may also comprise a groove forming the remaining portion of the enclosure. The groove may be substantially straight. At least a portion of the groove may be laser formed. At least a portion of the groove may be formed using an electric discharge machine.

The diamond may be sintered to a hard material selected from the group consisting of tungsten carbide, a cemented metal carbide, niobium carbide, silicon carbide, or combinations thereof.

In another aspect of the invention, an abrasion resistant nozzle may comprise a plurality of sintered diamond bodies, each comprising at least one flat, mating, exterior surface and a thickness, each mating surface being held against another surface under compression such that there are at least two pairs of mating surfaces. An enclosure may be formed in the plurality of bodies, at least one surface of each pair of mating surfaces comprising a groove forming a portion of the enclosure and the other surface of the mating surfaces forming a remaining portion of the enclosure. The enclosure may connect an entry and an exit formed in at least one side of at least one of the bodies. The surface may be diamond, cubic boron nitride, a cemented metal carbide or a combination thereof.

In some embodiments, the diamond may be sintered in a high pressure high temperature press to a carbide substrate. In some embodiments, the diamond may be formed around a carbide core, which may be grit blasted out to form the groove. In some embodiments, the groove may polished by flowing an abrasive material through the groove.

It should be noted for purposes of this application that the term "fluidic nozzle" describes the nozzle that causes at least two streams to interact with each other.

DETAILED DESCRIPTION OF THE INVENTION AND THE PREFERRED EMBODIMENT

Figure 1:
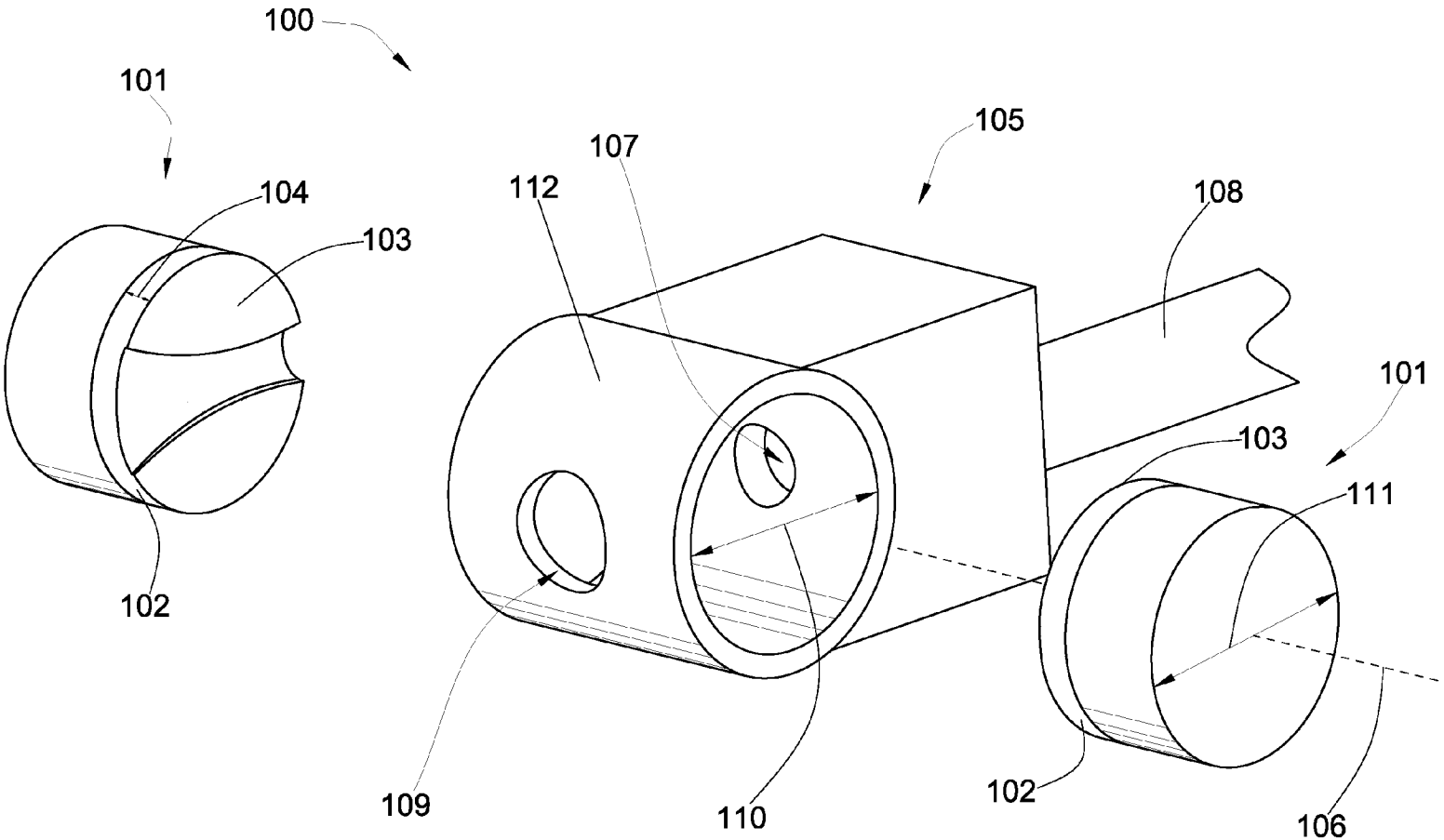
FIG. 1 is an exploded diagram of an embodiment of a nozzle.

FIG. 1 is an exploded diagram of an embodiment of an abrasion resistant nozzle 100 wherein the current invention may be used. The nozzle 100 comprises inserts 101, wherein the inserts comprise at least two sintered diamond bodies 102 comprising flat, mating, exterior surfaces 103 and a thickness 104. A cylindrical band 112, of a nozzle casing 105 may be shrink fit around the inserts 101 such that the mating surfaces 103 are held against each other under compression with a compressive load of 2000 psi. In this embodiment, the compression is radial with respect to a longitudinal axis 106 of the inserts 101. Under compression the mating surfaces 103 form an enclosure (See no. 300 in FIG. 3) through which fluid may pass. The fluid may pass through a first bore 107 in the nozzle casing 105 from a fluid source or conduit 108 attached to the casing 105 at a back portion of the casing 105. The casing 105 also comprises a second bore 109 in the cylindrical band 104, allowing the fluid to exit the nozzle 100. The fluid may be at a high pressure and/or velocity.

The nozzle casing 105 may be made of steel or other hard material. The casing 105 may be heated until an inside diameter 110 of the cylindrical band 104 increases to a size larger than a diameter 111 of the inserts 101, such that the inserts 101 may be inserted into the cylindrical band 104. As the nozzle casing 105 cools, a shrink fit is created around the diameter 111 of the inserts which may comprise an interference of 0.0001 to 0.002 inches.

Figure 2:
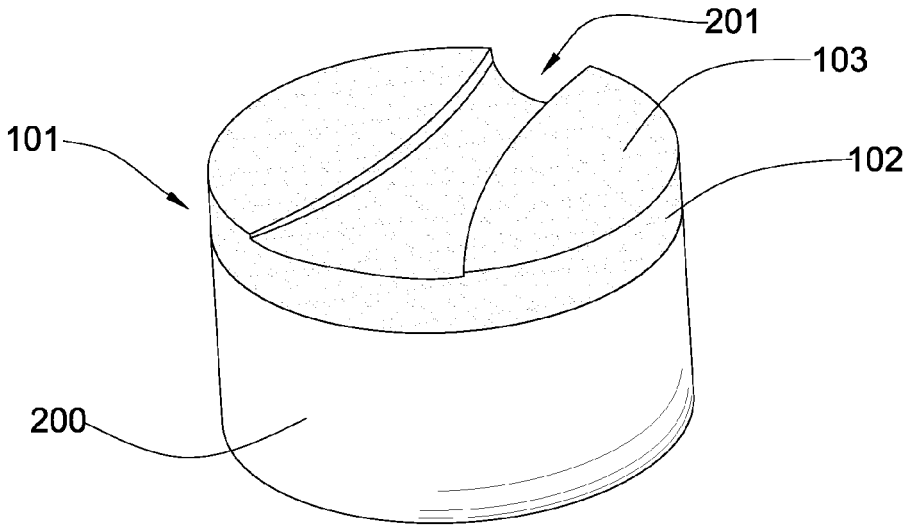
FIG. 2 is a perspective diagram of an embodiment of a sintered diamond body.

Each diamond body 102 may be sintered to a hard material 200, as in the embodiment of FIG. 2. The hard material 200 may be selected from the group consisting of tungsten carbide, a cemented metal carbide, niobium carbide, silicon carbide, or combinations thereof. The flat, mating surface 103 of at least one of the bodies 102 comprises a groove 201 which forms a portion of the enclosure 300. The groove 201 may be formed using an electric discharge machine, a laser, or other method for cutting diamond. The groove is formed generally along the mating surface and generally comprises two groove side walls connected by a groove bottom. In some embodiments, the groove bottom is closed forcing the fluid to pass along and between the mating surfaces. In some embodiments, it may be desirable to form a concave, flat, sharp, round, and/or convex generally shaped groove bottom to manipulate the flow within the enclosure.

Figure 3:
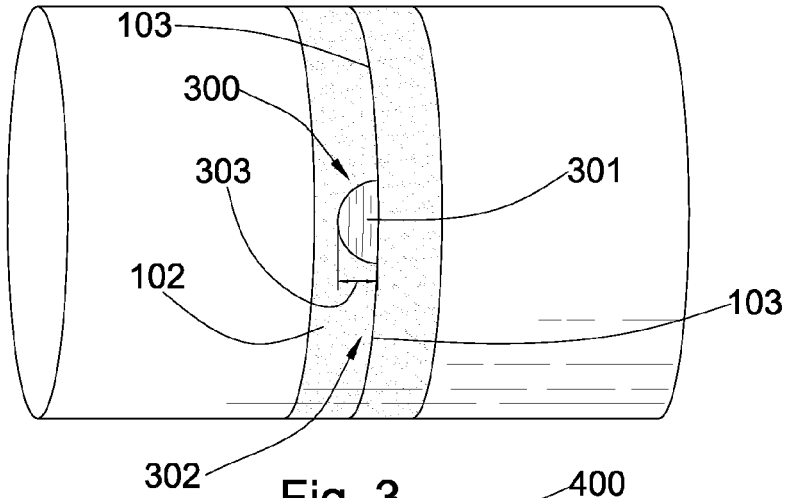
FIG. 3 is a perspective diagram of an embodiment of sintered diamond bodies with mated surfaces.
Figure 4:
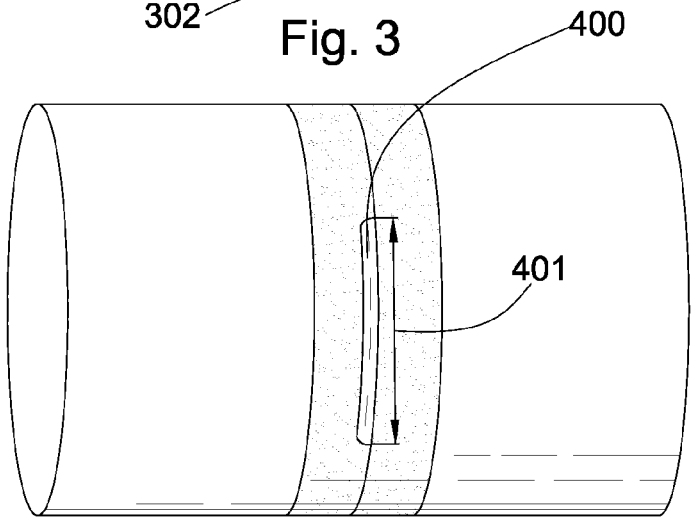
FIG. 4 is a perspective diagram of another embodiment of sintered diamond bodies with mated surfaces.

Referring also to FIGS. 3 and 4, the other mating surface 103 forms a remaining portion of the enclosure 300. In some embodiments the other mating surface is part of a solid diamond body. In other embodiments, the other mating surface is part of a closed diamond body. The enclosure 300 also connects an entry 301 and an exit 400 formed at least partially in at least one side 302 of at least one of the bodies 102. The side 302 may be an outer circumference of a cylinder. The groove 201 may comprise a varied depth 303 and/or width 401, which may be advantageous for different applications of the current invention. In the current embodiment, the entry 301 comprises a greater depth 303 and narrower width 401 than the exit 400. This may direct the fluid to fan out upon exiting the nozzle, such that the fluid covers a greater area.

Figure 5:
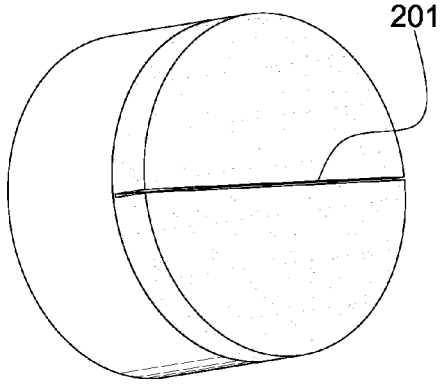
FIG. 5 is a perspective diagram of another embodiment of a sintered diamond body.
Figure 6:
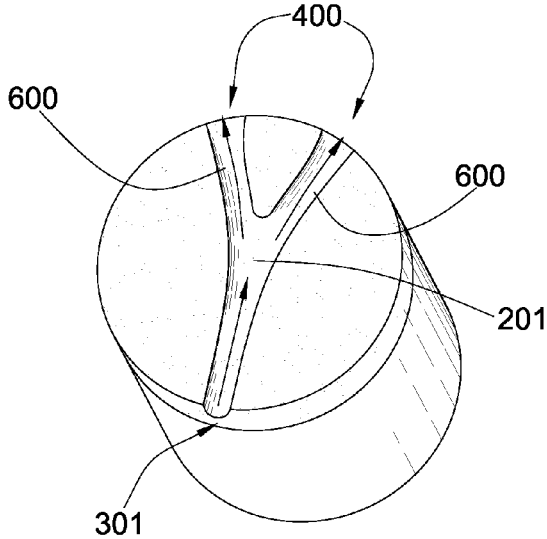
FIG. 6 is a perspective diagram of another embodiment of a sintered diamond body.
Figure 7:
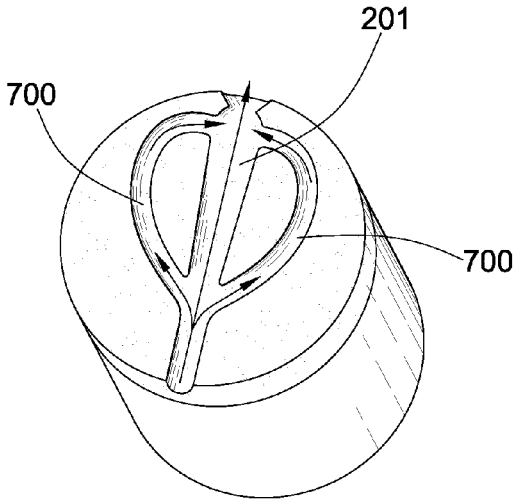
FIG. 7 is a perspective diagram of another embodiment of a sintered diamond body.
Figure 8:
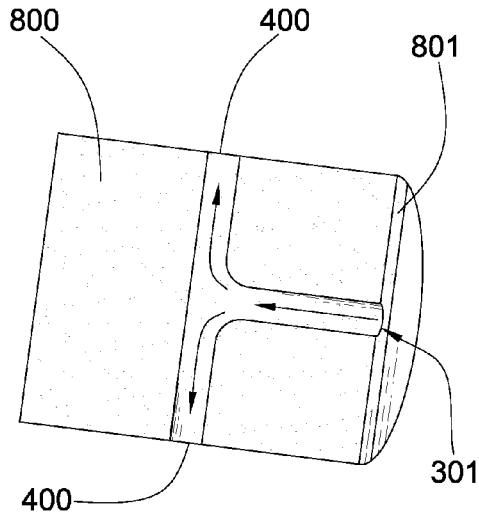
FIG. 8 is a perspective diagram of another embodiment of a sintered diamond body.

Forming the groove 201 using a laser may allow the groove to be a narrow slit, as in the embodiment of FIG. 5. The goove 201 may connect the entry 301 with a plurality of exits 400 through diverging pathways 600 in the groove 201, as in the embodiment of FIG. 6. The plurality of exits 400 may allow the fluid to cover a larger area than with one exit 400. The groove 201 may comprise a plurality of side channels 700 which may allow the nozzle 100 to be a fluidic nozzle, as in the embodiment of FIG. 7. Fluid flowing through the side channels 700 may change the direction of the fluid exiting the nozzle in an oscillating pattern. The flat, mating surface may comprise any shape, such as the rectangular shaped surface 800 in the embodiment of FIG. 8. The entry 301 may be formed in a different side 801 than the exit 400. Exits 400 may also be formed in different sides, though the exits may be formed in the same side. The entry 301 may also be formed in the same side as at least one exit.

Figure 9:
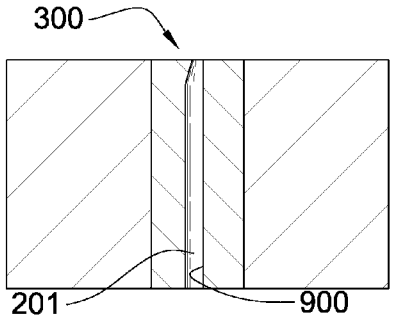
FIG. 9 is a cross-sectional diagram of another embodiment of sintered diamond bodies with mated surfaces.
Figure 10:
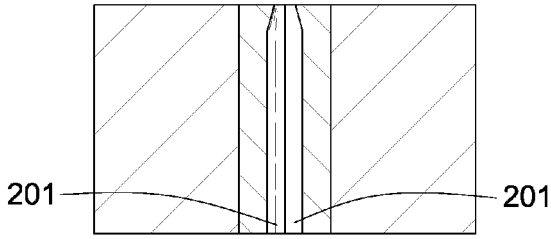
FIG. 10 is a cross-sectional diagram of another embodiment of sintered diamond bodies with mated surfaces.
Figure 11:
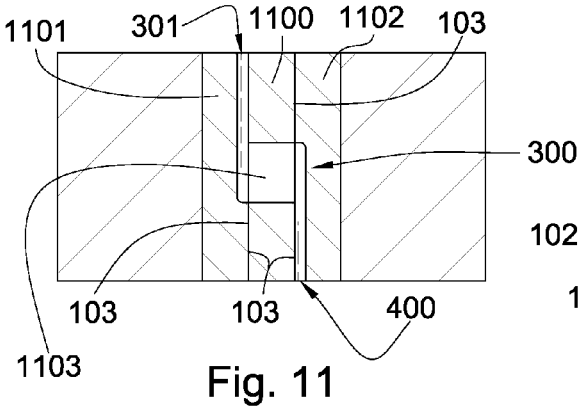
FIG. 11 is a cross-sectional diagram of another embodiment of sintered diamond bodies with mated surfaces.
Figure 12:
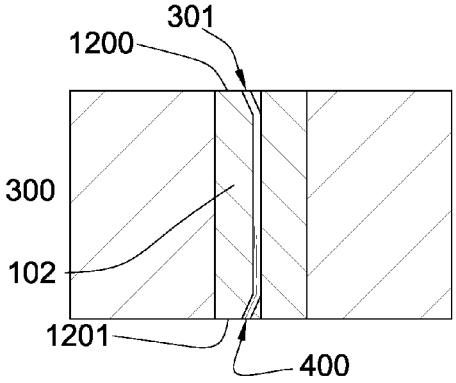
FIG. 12 is a cross-sectional diagram of another embodiment of sintered diamond bodies with mated surfaces.
Figure 12A:
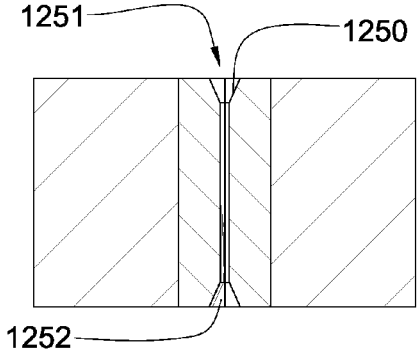
FIG. 12*a* is a cross-sectional diagram of another embodiment of sintered diamond bodies with mated surfaces.

The enclosure 300 may be formed by a groove 201 in one mating surface 103 and a flat area 900 of the other mating surface, as in the embodiment of FIG. 9, or it may be formed by grooves 201 in each of the mating surfaces 103, as in the embodiment of FIG. 10. The nozzle 100 may comprise a plurality of diamond bodies 1100, 1101, 1102, each comprising at least one mating surface 103 being held against another mating surface 103 under compression, as in the embodiment of FIG. 11. A third body 1100 comprising two mating surfaces 103 may be intermediate two other bodies 1101, 1102, such that there are two pairs of mating surfaces. The third diamond body 1100 may initially have been bonded to a hard material, but it may be ground off before the body 1100 is placed intermediate the other bodies 1101, 1102. The third body 1100 may comprise a bore 1103 forming a portion of the enclosure 300. The entry 301 and exit 400 may be formed in separate bodies. The entry 301 may be formed entirely in one side 1200 of one of the diamond bodies 102, as in the embodiment of FIG. 12. The exit 400 may also be formed entirely in another side 1201 of one of the diamond bodies 102. FIG. 12*a* discloses at least one of the diamond bodies comprising a chamfer 1250. A chamfer 1250 provides the advantage of mitigating stress that may be induced from shrink fitting a casing around the diamond bodies. The gap 1251 formed by the chamfer 1250 may be filled with a wear resistant material 1252 that may deform and seal off the gap during the shrink fitting process to prevent leaking.

In some embodiments, it may be desire to form the exit or entry of the enclosure on a flat formed into the edge of at least one of the diamond bodies.

Figure 13:
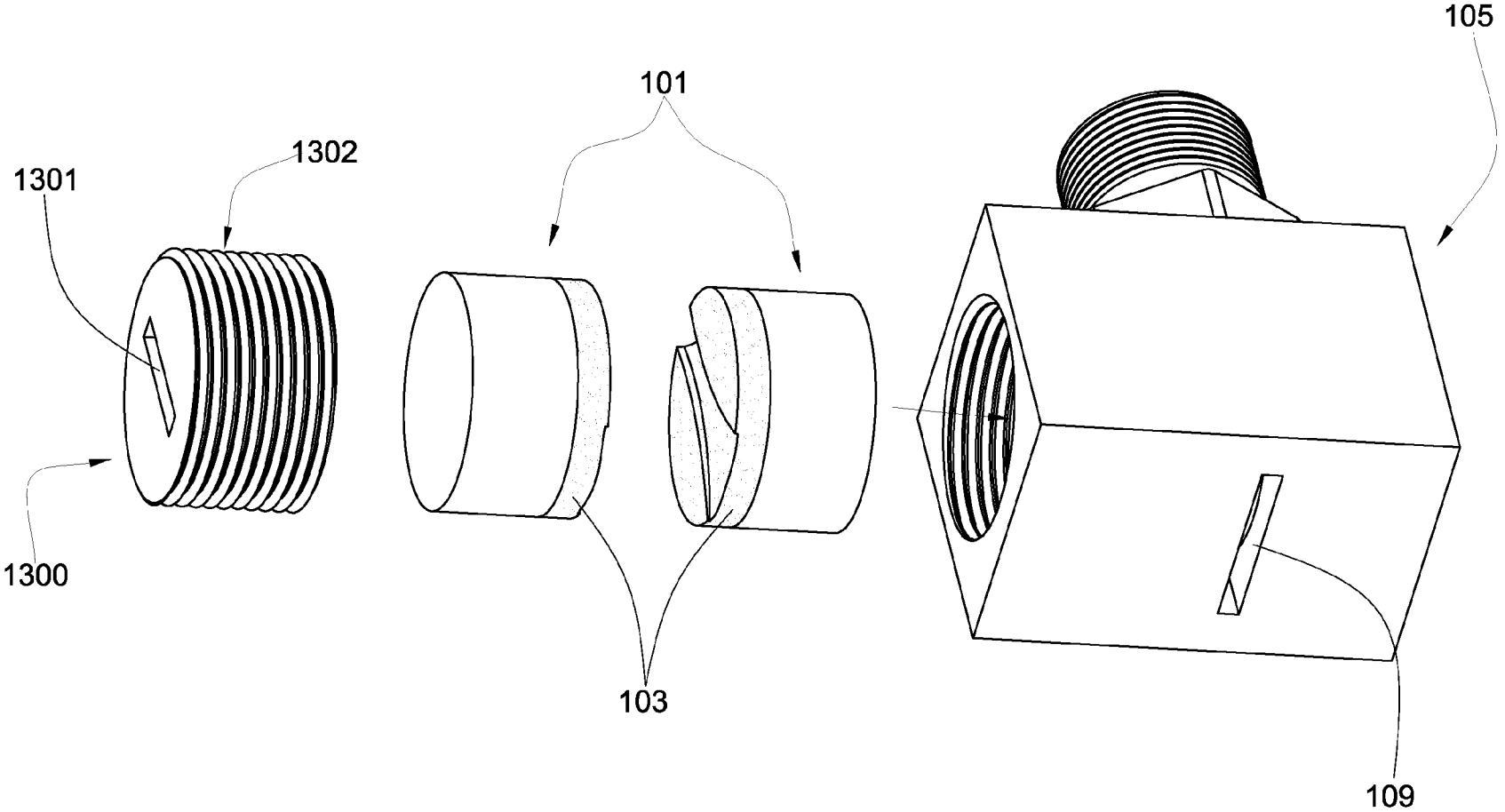
FIG. 13 is an exploded diagram of another embodiment of a nozzle.

The mating surfaces 103 may be compressively held together within the nozzle casing 105 by a threaded plug 1300, as in the embodiment of FIG. 13. The inserts 101 may be inserted into the nozzle casing 105 such that the exit 400 is aligned with the bore in the bottom of the casing 105 where the fluid may exit. The bore 109 may be rectangular to match the exit 400. The plug 1300 may comprise a depression 1301 in an outer surface such that the plug 1300 may be tightened in order to place the surfaces 103 under the desired amount of compression. The thread 1302 on the plug 1300 may comprise a pitch such that a linear force against the plug 1300 due to the compression of the surfaces 103 does not cause the plug 1300 to rotate.

Figure 14:
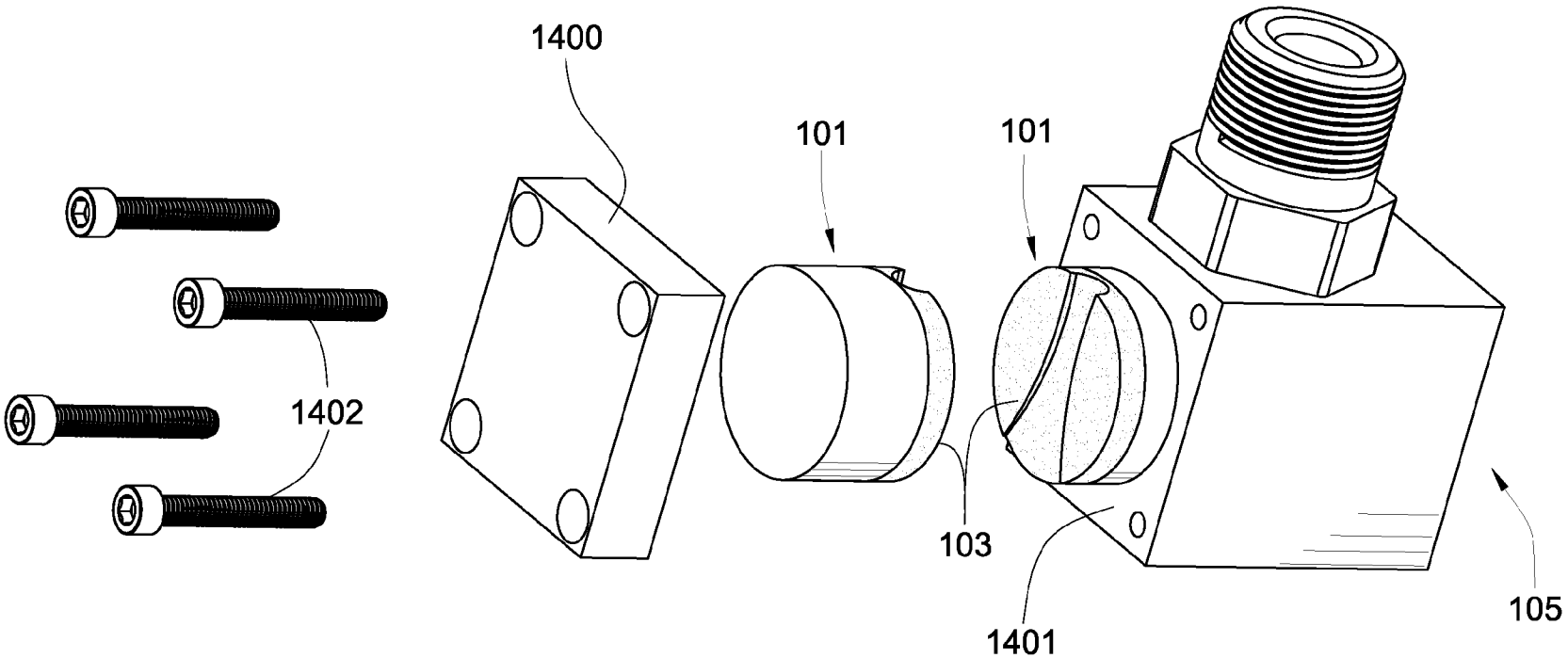
FIG. 14 is an exploded diagram of another embodiment of a nozzle.

Referring to the embodiment of FIG. 14, the nozzle casing 105 may comprise a plate 1400 fastened to a side 1401 of the casing. The plate 1400 may be fastened to the casing 105 by a plurality of fasteners 1402 such as screws in order to provide the desired compression on the mating surfaces 103 inside the casing. A portion of one of the inserts 101 may extend beyond a length 1403 of the casing 105, such that the plate 1400 may apply a force on the inserts 101. The plate 1400 may be made of a thick, hard metal designed to withstand outward forces due to the inserts 101 being under compression.

Figure 15:
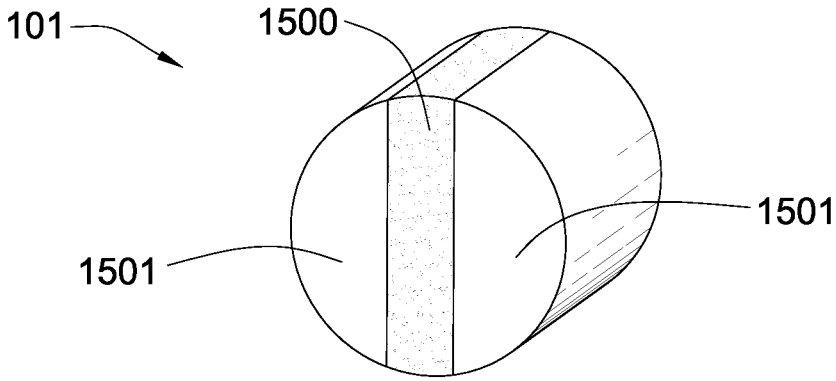
FIG. 15 is a perspective diagram of another embodiment of a nozzle.
Figure 16:
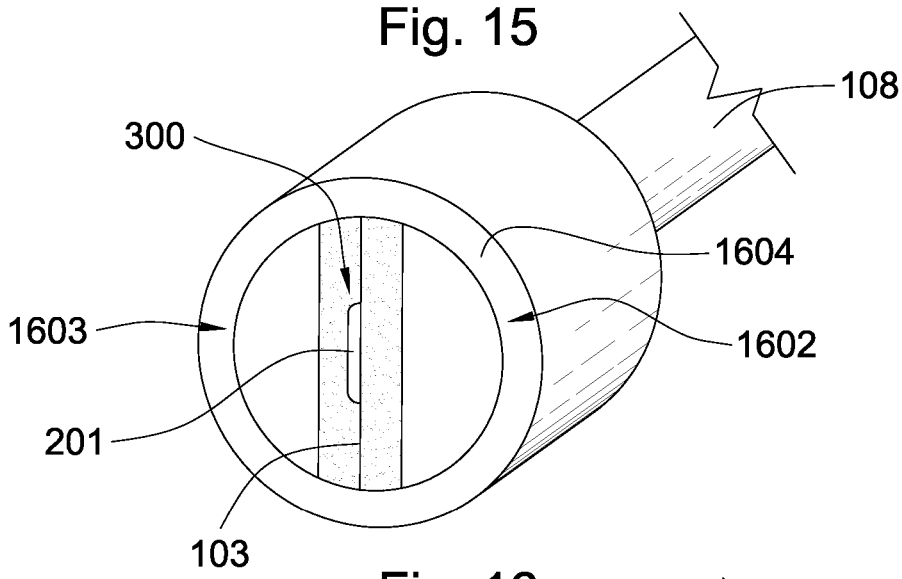
FIG. 16 is a perspective diagram of another embodiment of a nozzle.

Referring now to the embodiments of FIGS. 15 and 16, both sintered diamond bodies may be formed from a single insert 101. The insert 101 may comprise a solid region 1500 of sintered diamond intermediate two regions 1501 of hard material. The insert may be cut into halves 1602, 1603 at the diamond region 1500, resulting in two diamond bodies 102, each comprising a rectangular mating surface 103. A groove 201 may then be formed into at least one of the mating surfaces 103, such that placing the two halves 1602, 1603 of the insert 101 back together forms the enclosure 300. The halves 1602, 1603 may be held under compression by a band 1604, which may be shrink fit around the halves 1602, 1603. The fluid conduit 108 may attach to a portion of the band 1604.

Figure 17:
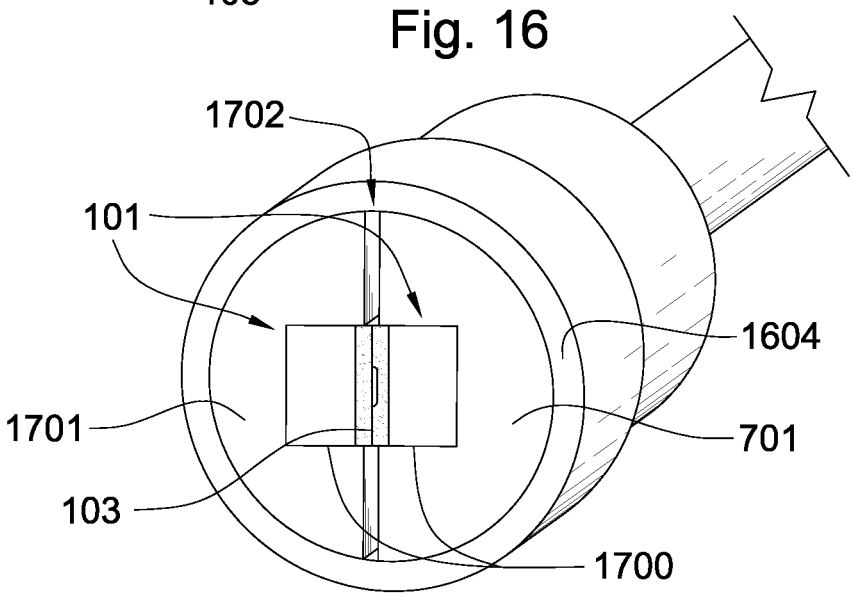
FIG. 17 is a perspective diagram of another embodiment of a nozzle.

The inserts 101 may be disposed within recesses 1700 in a pair of cylindrical halves 1701, as in the embodiment of FIG. 17. A band 1604 may be shrink fit around the cylindrical halves 1701, causing the mating surfaces 103 of the inserts 101 to be held together compressively. A gap 1702 may separate the cylindrical halves 1701 before compression is applied, which may allow the mating surfaces 103 to bear the compressive load.

Figure 18:
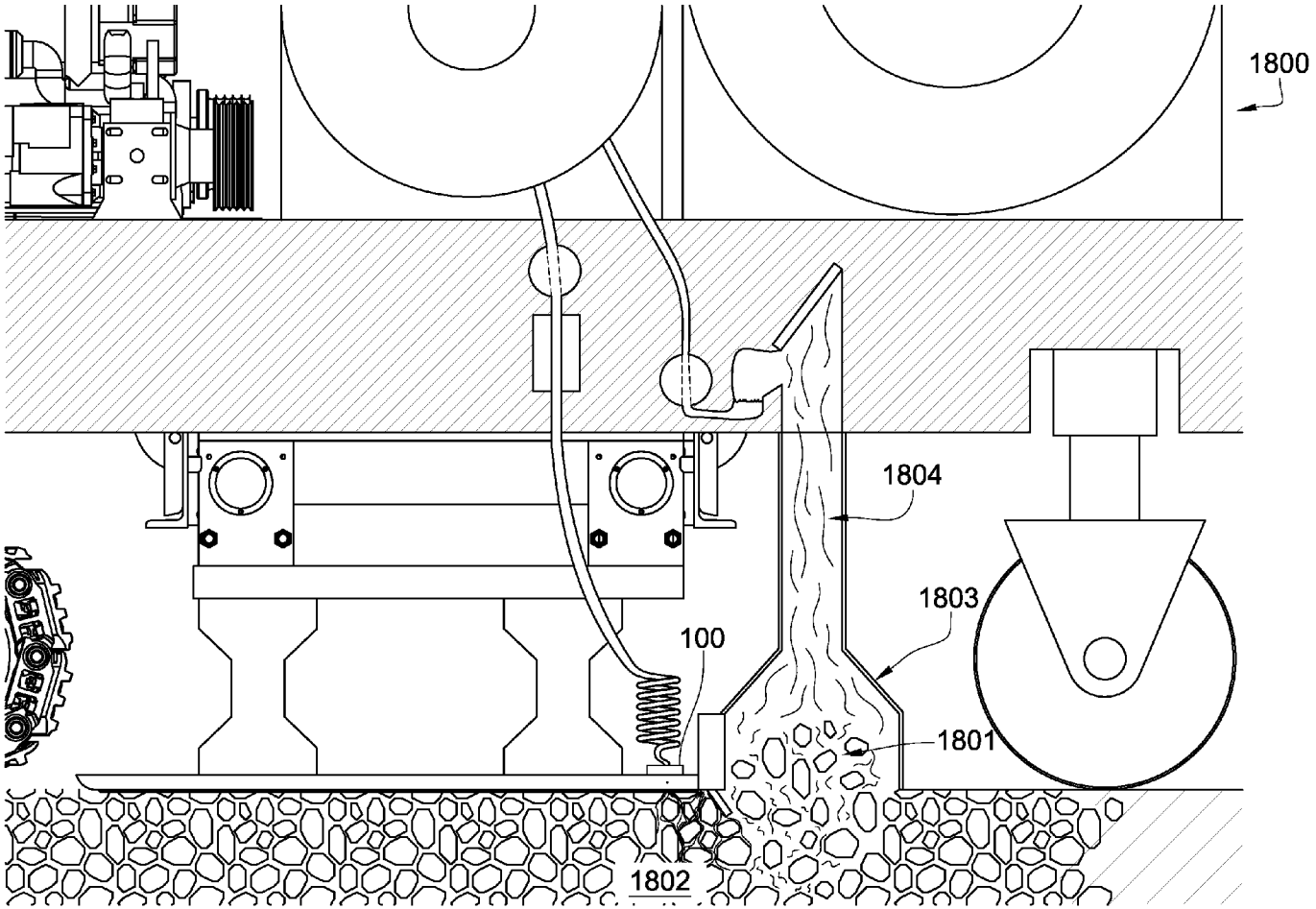
FIG. 18 is a cross-sectional diagram of an embodiment of an asphalt milling machine.
Figure 19:
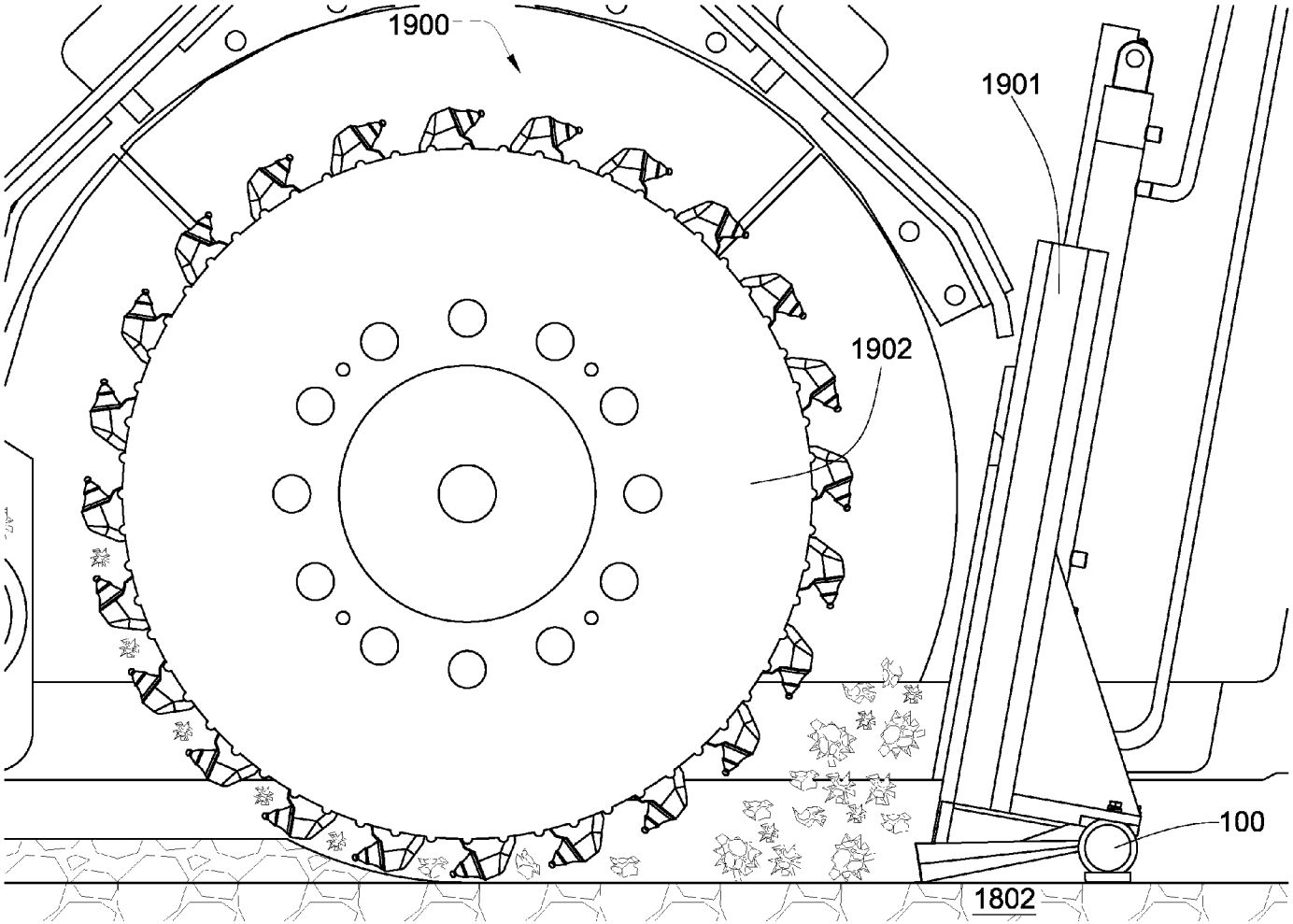
FIG. 19 is a cross-sectional diagram of another embodiment of a pavement milling machine.
Figure 20:
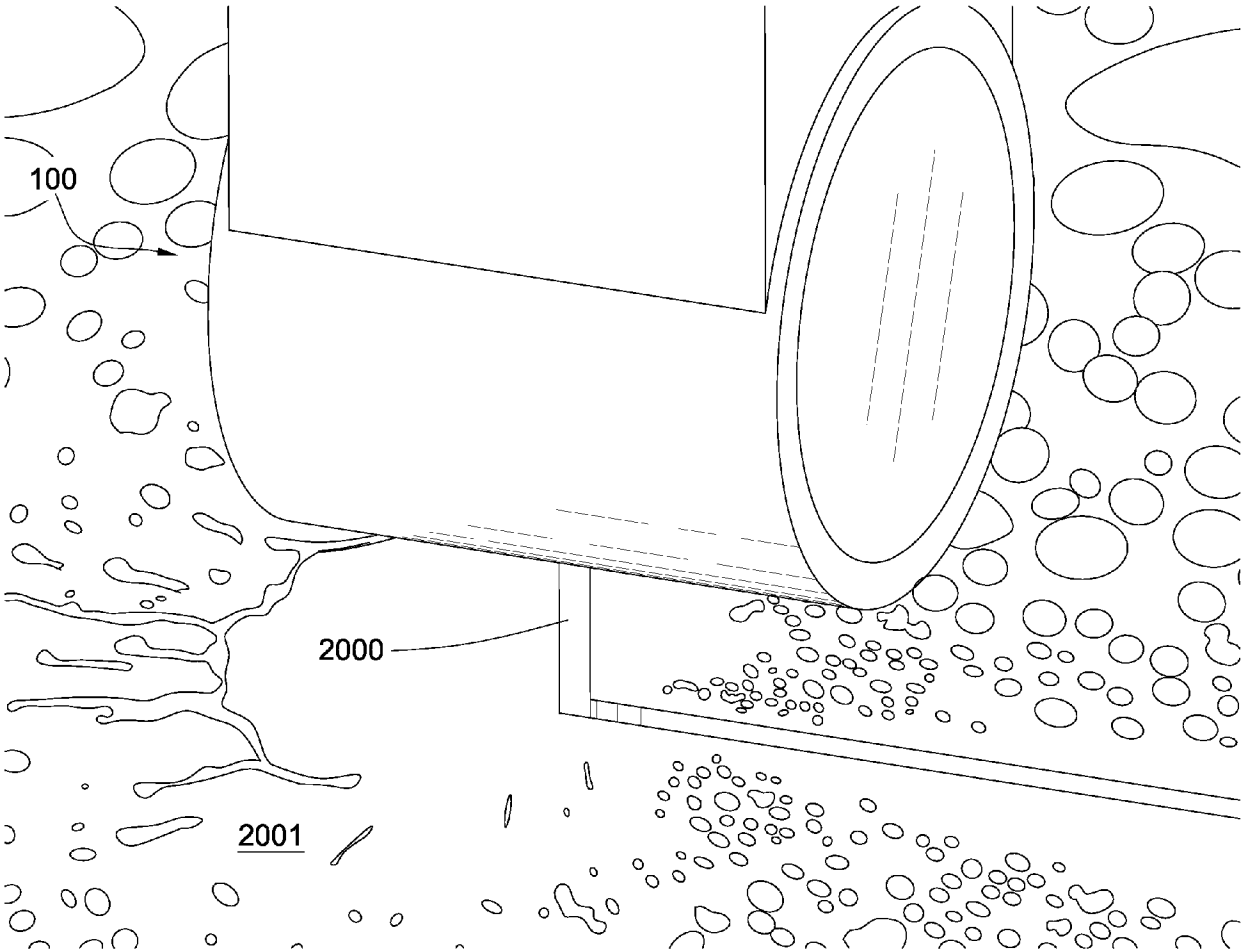
FIG. 20 is a perspective diagram of a water cutting apparatus.

The current invention may be useful in road resurfacing machines 1800, such as the machine in the embodiment of FIG. 18. The nozzles 100 may be used to emit a fluid under high pressure such that aggregate 1801 pops out of the asphalt surface 1802 into a depressurization chamber 1803, where resurfacing materials 1804 may be added and the aggregate is re-compacted into a new road. Such a system is described in U.S. patent application Ser. Nos. 11/470,570 and 11/558,605 which are herein incorporated by reference for all that they contain. The nozzle 100 may be used in pavement milling machines 1900, as in the embodiment of FIG. 19. The nozzles 100 may be placed on a moldboard 1901 proximate the asphalt surface 1802 and behind a rotary milling drum 1902 in order to clean the milled pavement surface 1802. In this embodiment, a nozzle 100 with a wide effective spray area may be desirable. Such a system is described in U.S. patent application Ser. Nos. 11/566,151 and 11/668,390 which are herein incorporated by reference for all that they contain. The nozzle 100 may also be used in water jet cutting applications, as in the embodiment of FIG. 20. The nozzle 100 may be designed to emit a narrow stream 2000 of fluid, which may be a mixture of water and abrasive materials, at extremely high pressures, as much as 30,000 to 60,000 psi or more, in order to cut hard surfaces 2001 or materials. Due to the abrasion resistance of the diamond bodies, these nozzles may last longer than typical water jet nozzles of the prior art. The abrasion resistant nozzles may also be used in coal furnaces; downhole drill bits such as percussion bits, shear bits, rotary drag bits, or roller cone bits; homogenizers; or other applications where heat or abrasive materials are used.

Whereas the present invention has been described in particular relation to the drawings attached hereto, it should be understood that other and further modifications apart from those shown or suggested herein, may be made within the scope and spirit of the present invention.

What is claimed is:

1. An abrasion resistant nozzle, comprising:

at least two sintered diamond bodies comprising flat, mating, exterior surfaces and a thickness, the surfaces being held against each other under compression;

a band shrink fit around the two mating surfaces wherein the band comprises a first and second bore therethrough where fluid may pass through;

an enclosure formed between the mating surfaces, at least one surface comprising a groove forming a portion of the enclosure and the other surface forming a remaining portion of the enclosure; and the enclosure connecting an entry and an exit formed at least partially in at least one side of at least one of the bodies.

2. The nozzle of claim 1, wherein the groove comprises a varied depth.

3. The nozzle of claim 1, wherein the groove comprises a varied width.

4. The nozzle of claim 1, wherein the other surface also comprises a groove forming the remaining portion of the enclosure.

5. The nozzle of claim 1, wherein the diamond is sintered to a hard material selected from the group consisting of tungsten carbide, a cemented metal carbide, niobium carbide, silicon carbide, or combinations thereof.

6. The nozzle of claim 1, wherein the nozzle comprises an exit narrower than the entry.

7. The nozzle of claim 1, wherein the groove is substantially straight.

8. The nozzle of claim 1, wherein the entry and exit are formed in the same side of one of the bodies.

9. The nozzle of claim 1, wherein the groove comprises a closed groove bottom.

10. The nozzle of claim 1, wherein the diamond bodies comprise a thickness of at least 0.050 inches.

11. The nozzle of claim 1, wherein at least one of the diamond bodies is closed.

12. The nozzle of claim 1, wherein at least one of the diamond bodies is solid.

13. The nozzle of claim 1, wherein at least a portion of the groove is a laser formed groove.

14. The nozzle of claim 1, wherein at least a portion of the groove is an electric discharge machine formed groove.

15. An abrasion resistant nozzle, comprising:

a plurality of sintered bodies, each comprising at least one flat, mating, exterior surface and a thickness, each mating surface being held against another surface under compression such that there are at least two pairs of mating surfaces;

a band shrink fit around the two pairs of mating surfaces wherein the band comprises a first and second bore therethrough where fluid may pass through;

an enclosure formed in the plurality of bodies, at least one surface of each pair of mating surfaces comprising a groove forming a portion of the enclosure and the other surface of the mating surfaces forming a remaining portion of the enclosure; and the enclosure connecting an entry and an exit formed in at least one side of at least one of the bodies.

* * * * *